United States Patent [19]

Frisz

[11] Patent Number: 4,515,509

[45] Date of Patent: May 7, 1985

[54] METHOD AND APPARATUS FOR OPENING A LOADED PLASTIC BAG AND REMOVING THE CONTENTS THEREOF

[76] Inventor: James O. Frisz, 921 Pear St., Brea, Calif. 92621

[21] Appl. No.: 467,437

[22] Filed: Feb. 17, 1983

[51] Int. Cl.[3] ..... B65B 69/00

[52] U.S. Cl. ..... 414/412; 414/786

[58] Field of Search ..... 414/412, 786, 78; 225/97; 222/81; 198/607, 406, 347

[56] References Cited

U.S. PATENT DOCUMENTS

| | | | |
|---|---|---|---|
| 624,023 | 5/1899 | Heine | 414/412 X |
| 1,916,531 | 7/1933 | Robb | 414/412 |
| 3,568,815 | 3/1971 | Wiseman | 198/607 X |
| 3,817,405 | 6/1974 | Neely, Jr. | 414/78 X |
| 3,891,105 | 6/1975 | Cerroni | 414/412 |
| 3,915,315 | 10/1975 | Miller | 414/78 X |
| 4,034,877 | 7/1977 | Bennison | 414/412 |
| 4,273,234 | 6/1981 | Bourgeois | 198/347 |

FOREIGN PATENT DOCUMENTS

| | | | |
|---|---|---|---|
| 1102046 | 3/1961 | Fed. Rep. of Germany | 414/78 |

*Primary Examiner*—Robert J. Spar
*Assistant Examiner*—David A. Bucci

[57] ABSTRACT

Bags are loaded onto a conveyor for movement along a predetermined path, at spaced intervals of which there are a plurality of bag opening stations, each of which includes a driven chain loop with a plurality of outwardly extending fingers. The fingers engage the bags as they go past and either directly pierce the plastic bags or lift them such that the loaded bag weight causes the fingers to pierce the bag material. Also, at some point in the path of elevation of the loaded bags lifted by the fingers, the bags fall onto the conveyor belt adding a rupturing force which in combination with the piercing of the bag materials effects bag opening and removal of the contents.

8 Claims, 10 Drawing Figures

METHOD AND APPARATUS FOR OPENING A LOADED PLASTIC BAG AND REMOVING THE CONTENTS THEREOF

The present invention relates generally to a method and apparatus for rupturing loaded closed plastic bags and removing the contents thereof, and, more particularly, to such a method and apparatus for accomplishing this expeditiously and on a quantity basis.

BACKGROUND

It is customary practice in the handling of trash or waste materials to place them in plastic bags and close the bags by tapes, twist-on means or other means. The so-filled bags are then loaded on trucks or other vehicles for transportation to a waste disposal facility where they are then unloaded for either temporary storage or immediate processing. A necessary step in the waste disposal process for loaded trash bags is to break them open and remove the contents for sorting and selective handling. For example, relatively large metal objects may be removed from the waste mass while combustible materials may be conveyed to a kiln or furnace for incineration.

At the present time, loaded plastic bags are typically opened by dropping from a sufficient height to effect rupture, subjecting to a compressive load, or to a lesser extent they are manually torn apart.

SUMMARY OF THE DISCLOSED INVENTION

In apparatus for practicing the described method of opening a sealed or closed plastic bag, the bags are loaded onto a conveyor for movement along a predetermined path. At spaced intervals along the path, there are loaded a plurality of bag opening stations, each of which includes a driven chain loop having a plurality of metal fingers extending outwardly therefrom, which fingers transversely engage the bags as they go past and either directly sever the plastic bag as the bags rest on the conveyor or lift the bags whereby the loaded bag weight causes the fingers to pierce the bag material. In this way, the bag material is pierced in a plurality of places allowing the contents to spill outwardly of the bag onto the conveyor belt. Also, at some point in the path of elevation of those loaded bags lifted by the fingers, the bags are released and they fall onto the conveyor belt adding a rupturing force which in combination with the piercing of the bag materials effects bag opening and removal of the contents. Camming means provide for retraction of the fingers during a part of their closed path movement so as to insure that the bags are not inadvertently retained at any bag opening station.

DESCRIPTION OF A PREFERRED EMBODIMENT

Figure 1:
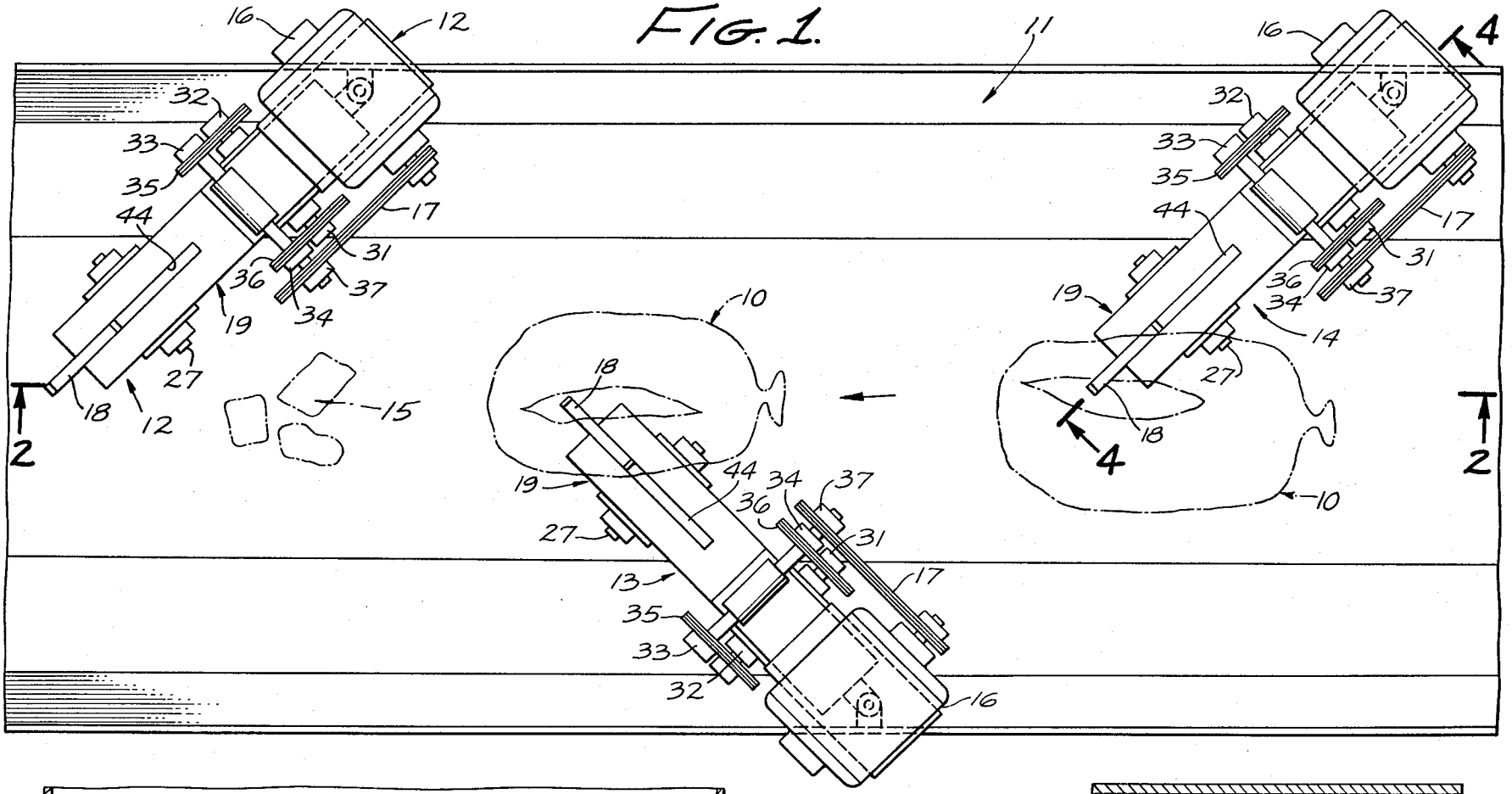
FIG. 1 is a top plan view, partially schematic, showing several bag opening stations of the apparatus of this invention in operation.
Figure 9:
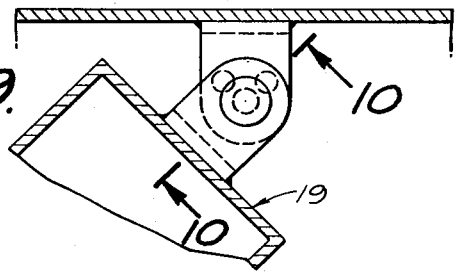
FIG. 9 is a sectional, elevational, partially fragmentary view taken along the line 9—9 of FIG. 2.

With reference now to the drawings, and particularly FIG. 1, a loaded plastic bag with which the method and apparatus to be described herein is advantageously employed is enumerated generally as at 10. For present purposes, such bags are contemplated as constructed of a relatively thin, flexible plastic material and loaded with waste materials, for example, after which the open ends of the bags are gathered together and closed or sealed by suitable means. In the process for bag opening in a manner to be described in detail later herein, the loaded bags 10 are located on the upper surface of a generally horizontal conveyor 11 which is driven along a predetermined course in the direction shown by the arrow by a suitable drive means (not shown). A plurality of bag opening apparatus 12, 13 and 14 are located at separate stations along the path of movement of the conveyor and at consecutively opposite sides of the conveyor, each having parts that extend transversely of the conveyor belt to engage the bags 10 as they move therepast to lift them up and break them open dropping the contents 15 on the conveyor.

Figure 2:
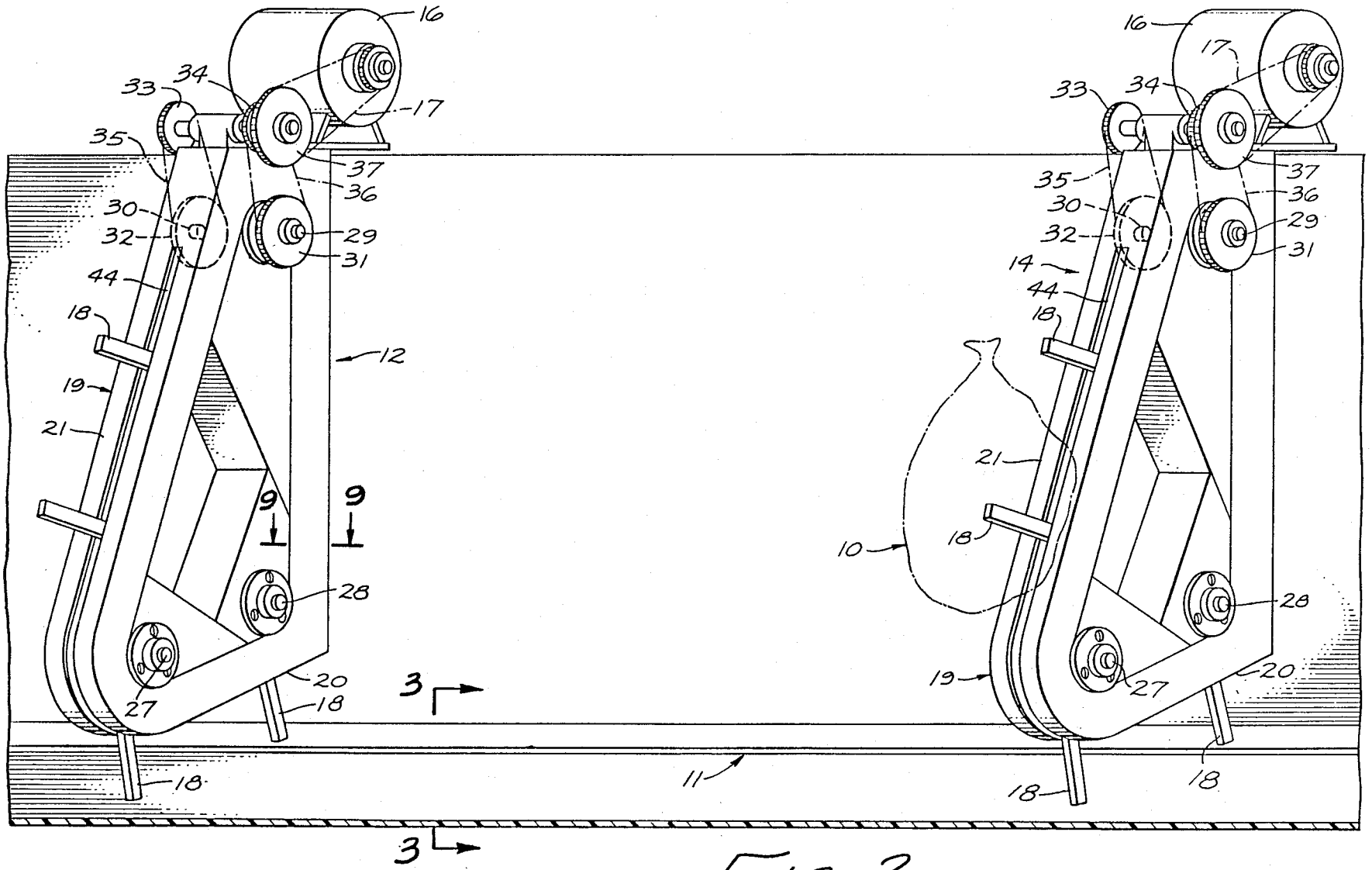
FIG. 2 is a side elevational view of two stations of the rupturing apparatus.

Turning now to FIG. 2, it is seen that each of the bag opening apparatus of the stations 12 through 14 are identical and for that reason only one will be described in detail. A rotative power source 16, such as an electric motor for example, mounted adjacent the conveyor 11 provides driving power through a sprocket 17 (schematically shown) for moving a set of severing and rupturing fingers 18 located within a substantially triangular housing 19 around a closed, generally vertical path. The fingers extend outwardly of the housing 19 along a housing lower edge 20 which extends transversely of the conveyor surface, and then upwardly along an outer housing edge 21 thereof. Camming means (not shown in FIG. 2) retracts the fingers 18 into the housing 19 throughout its return trip along the remaining side of the housing 19. As to operation generally, a loaded bag 10 is engaged by the fingers 18 as it moves past each station, which fingers pierce the bag material, lift the bag and then drop it back onto the conveyor. Occassionally, depending upon the weight of the loaded bag and the bag material thickness, it may have to be acted upon in several stations before the entire bag contents are removed.

Figure 5:
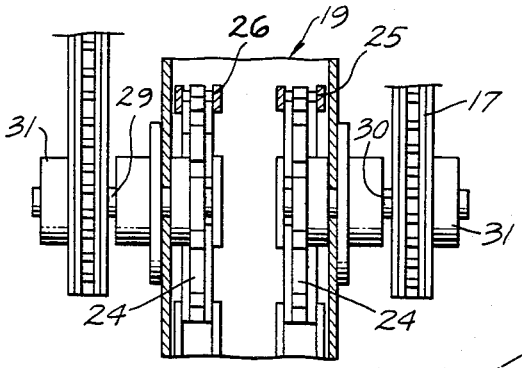
FIG. 5 is a sectional, elevational, partially fragmentary, view taken along the line 5—5 of FIG. 4.
Figure 4:
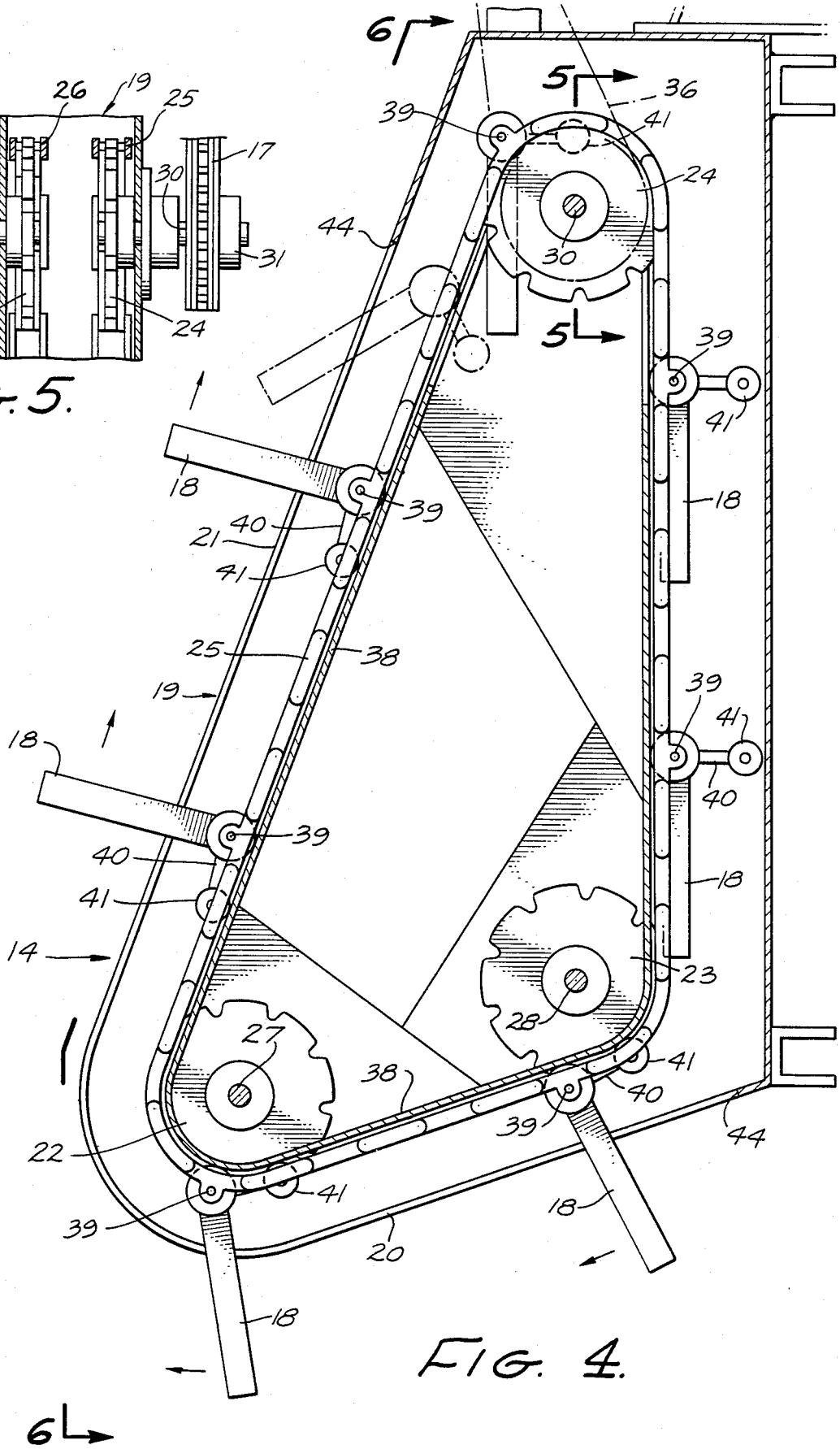
FIG. 4 is a side elevational, sectional view taken along the line 4—4 of FIG. 1.

For the apparatus details reference is now made to both FIGS. 4 and 5, each set of bag opening apparatus is seen to include three sets of sprockets 22, 23, and 24 arranged as points of a triangle with sides parallel to the housing 19 sides. Each of the sets of sprockets as best seen in FIG. 5 includes a pair of sprocket wheels mounted in spaced apart relation for meshing with and driving a pair of sprocket chains 25 and 26. More particularly, the sprocket sets 22 and 23 each include a pair of sprocket wheels mounted on individual shafts 27 and 28, respectively, having their outer ends journaled in the side walls of the housing 19. The sprocket set 24 includes a pair of sprocket wheels spaced apart the same distance as sprocket wheels of the sets 22 and 23 are mounted on individual shafts 29 and 30 (FIG. 6).

Turning again to FIG. 2, the outer ends of the shafts 29 and 30 include driving sprockets 31 and 32, one at each side of the housing 19, which are interconnected to further sprocket wheels 33 and 34 mounted on the top of housing 19 via chains 35 and 36. Accordingly, rotative power from the motor 16 via chain 17 drives sprocket 37 and sprockets 33 and 34, which, in turn, via chains 35 and 36 drive the sprocket wheels 31 and 32 to rotate shafts 29 and 30 and thus the internal sprocket wheels 24. Rotation of the set of sprocket wheels 24 drives the chains 25 and 26 in unison about the sprockets 22 and 23.

Located immediately adjacent and slightly spaced inwardly of the chains 25 and 26 and centrally therebetween, is a camming plate 38 (FIG. 4) which extends along the length of the chains 25 and 26 except for that portion of the chains in the region of the set of sprockets 24 and for a short distance along each of the legs of the housing triangle on moving away from the sprocket set 24.

Figure 6:
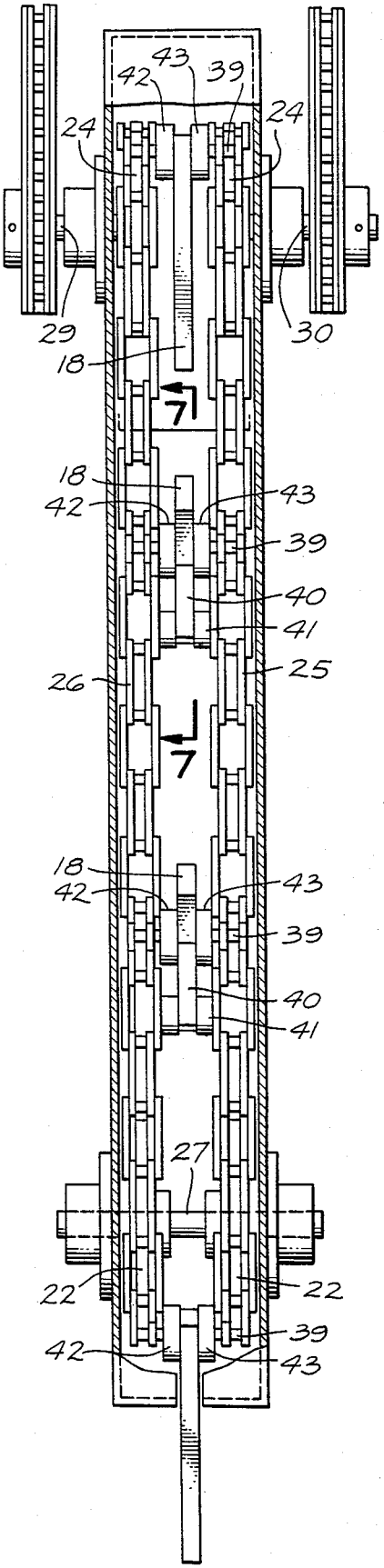
FIG. 6 is a sectional, elevational view taken along the line 6—6 of FIG. 4.
Figure 7:
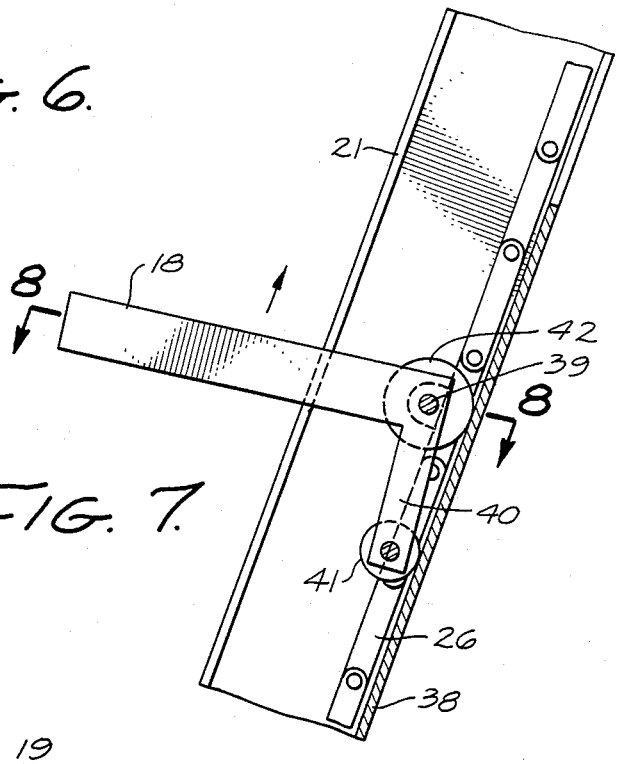
FIG. 7 is a side elevational, partially fragmentary view taken along the line 7—7 of FIG. 6.
Figure 10:
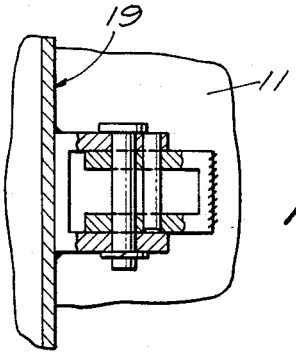
FIG. 10 is a sectional view taken along the line 10—10 of FIG. 9.
Figure 8:
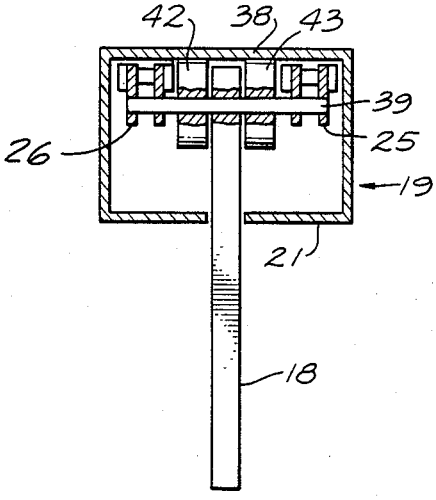
FIG. 8 is a plan sectional view taken along the line 8—8 of FIG. 7 through one of the rupturing fingers.

For the ensuing description of the finger 18 construction reference is made to FIGS. 4, 6 and 8. Each of the rupturing fingers 18 is seen to include a generally elongate, substantially rectangular body, one end of which is pivotally interconnected to both of the chains 25 and 26 via a shaft 39. An L-shaped arm 40 is located at the point of pivotal interconnection with the chains and extends at substantially 90 degrees from the main finger body. The outer end of the arm 40 has a camming roller 41 for a purpose to be described. In addition, first and second oversize rollers 42 and 43 (FIG. 8) are received on the shaft 39, one at each side of 18, and are of such diameter as to provide rolling engagement with camming plate 38.

As the chains 25 and 26 rotate about the sprocket sets 22–24, the camming plate 38 engages the camming roller 41 and rollers 42, 43 associated with each of the rupturing fingers and cams the fingers outwardly of the housing 19 into actuating position as is shown at the left in FIG. 4, for example. As the fingers move upwardly and beyond the reach of the camming plate 38 into the space beyond the plate edges adjacent to the sprocket set 24, the rollers are no longer supported by the plate 38. Gravity now causes the fingers to swing downwardly with the main body thereof lying first inwardly of the chain as shown at the top of FIG. 4 and then for a extent shown at the right of FIG. 4 where the fingers lie substantially parallel to the chain. Again, as the finger reaches the lower right hand portion of FIG. 4, it drops by gravity through the slot 44 in the housing 19 to extend outwardly from the housing with the camming roller 41 once again being brought into contact with the camming plate 38.

Figure 3:
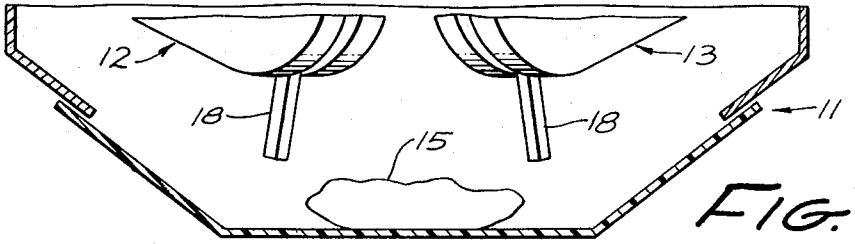
FIG. 3 is an end elevational, sectional view taken through the conveyor and lower portions of the bag opening apparatus along line 3—3 of FIG. 2.

Returning to FIG. 1, in operation the loaded bags 10 deposited on the conveyor 11 are transported past the various stations 12 through 14 consecutively, where the rotating fingers 18 engage the bags simultaneously piercing and lifting the bags upwardly, with the combination of the tearing movement of the fingers and the weight of the bag effecting rupturing of the bag to drop the contents on the conveyor belt 11. As shown in FIG. 3, these waste materials 15 are then conveyed away for subsequent sorting, separating or further handling to effect waste disposal. Each of the described apparatus 12–14 is pivotally mounted to a side wall adjacent the conveyor as to permit swinging of the apparatus away from the conveyor in the event repair of or access to the conveyor mechanism is required. In the preferred manner, during use the bag bursting apparatus is arranged so that the plane of movement of the rupturing fingers is substantially at 45 degrees to the direction of movement of the bags therealong.

I claim:

1. A method of removing the contents from a flexible-walled baglike container, which comprises the steps of:

moving the container along a define path on a surface;

moving a plurality of fingerlike members along a closed path including a first part extending transversely of the definite path and a consecutively adjacent second part extending vertically upward from the definite path;

intercepting the container with the fingers as the container moves therepast to rupture the baglike container and initiate release of the contents onto said surface;

lifting the baglike container along the second part of the closed path while allowing the contents to fall from the ruptured container to said surface; and dropping the baglike container back onto said surface to further rupture the bag and further release the contents.

2. A method as in claim 1, including intercepting the baglike container by a further plurality of fingers located along the definite path of movement and moving transversely opposite to the transverse movement of the first recited plurality of fingers.

3. A method as in claim 1, in which the fingers pierce the container wall.

4. Apparatus for removing the contents from a sealed baglike container, comprising:

a conveyor for moving the container along a predetermined path, said conveyor having an upwardly facing surface on which the container is received; and a container treatment station located along the conveyor including, a closed loop of sprocket chain mounted on sprocket wheels in a plane generally vertical to the conveyor flat surface, a plurality of finger means pivotally connected to the sprocket chain, means for driving the sprocket wheels to move the chain transversely across at least a portion of the conveyor flat surface and then vertically away from said surface at a predetermined point directly opposite said conveyor upwardly facing surface, and means for extending the finger means outwardly from the chain toward the conveyor during the transverse movement across conveyor portion to intercept and pierce the container with said finger means and lifting the intercepted and then pierced container during movement away from said conveyor surface so as to enable the contents to fall onto said conveyor.

5. Apparatus as in claim 4, in which a plurality of container treatment stations are located in a mutually spaced relation along the conveyor path of movement.

6. Apparatus as in claim 5, in which consecutively adjacent stations are located at opposite sides of the conveyor path of movement and the driving means move the respective chains transversely opposite each other.

7. Apparatus as in claim 4, in which the sprocket chain, finger means, driving means and extending means are mounted within a housing and the extending means moves the finger means outwardly of the housing during transverse movement across the conveyor portion and during movement away from said conveyor surface, and means for withdrawing the finger means within the housing after movement away from the conveyor surface a predetermined amount.

8. Apparatus as in claim 4, in which the sprocket wheels are driven in a constant direction, and said finger extending means includes a camming plate which engages parts of the finger means as they move therepast to move other parts of the finger means transversely extending from the sprocket chain.

* * * * *